United States Patent [19]

Anderson

[11] Patent Number: 5,005,608

[45] Date of Patent: Apr. 9, 1991

[54] SPLIT HEDDLE WITH SUPERIMPOSED BLADES WITH ALIGNED APERTURES

[75] Inventor: Larry D. Anderson, Appleton, Wis.

[73] Assignee: Asten Group, Inc., Charleston, S.C.

[21] Appl. No.: 472,720

[22] Filed: Jan. 31, 1990

[51] Int. Cl.[5] ..... D03C 9/02

[52] U.S. Cl. ..... 139/93

[58] Field of Search ..... 139/383 AA, 35, 93-94, 139/95, 96, 51, 52, 53, 355-357; 28/198, 205-207, 201, 202, 203 R, 203 A, 208, 209

[56] References Cited

U.S. PATENT DOCUMENTS

| | | | |
|---|---|---|---|
| 880,215 | 2/1908 | Hiller . | |
| 1,079,470 | 11/1913 | Colman . | |
| 1,082,474 | 12/1913 | Colman . | |
| 1,107,345 | 8/1914 | Pickard | 139/95 |
| 1,245,418 | 11/1917 | Alford . | |
| 1,341,244 | 5/1920 | Ruegg | 139/93 |
| 1,779,312 | 10/1930 | Hammer . | |
| 2,011,115 | 8/1935 | Peterson . | |
| 2,039,157 | 4/1936 | Fleischer . | |
| 2,249,390 | 7/1941 | Mahler | 139/93 |
| 2,385,703 | 9/1945 | Heiber | 139/1 |
| 2,449,691 | 9/1948 | Deal . | |
| 2,523,932 | 9/1950 | Abbott . | |
| 2,786,256 | 3/1957 | Axelsson | 28/1 |
| 2,800,927 | 7/1957 | Silberman et al. . | |
| 2,845,686 | 8/1958 | Mason | 28/1 |
| 2,863,492 | 12/1958 | Chang et al. . | |
| 3,885,596 | 5/1975 | Alexeff | 139/28 |
| 3,962,762 | 6/1976 | Alexeff | 28/72 R |
| 3,974,551 | 8/1976 | Baer et al. . | |
| 3,990,732 | 11/1976 | Reichert . | |
| 4,152,815 | 5/1979 | Altenweger . | |
| 4,175,307 | 11/1979 | Altenweger . | |
| 4,194,538 | 3/1980 | Borodin et al. . | |
| 4,410,015 | 10/1983 | Koller et al. | 139/383 A |
| 4,506,707 | 3/1985 | Shimizu | 139/91 |
| 4,581,794 | 1/1989 | Oldroyd et al. | 28/141 |

OTHER PUBLICATIONS

Publication by Samuel Dracup and Sons Ltd., Lane Close Mills, Great Horton, no date supplied.

*Primary Examiner*—Andrew M. Falik

*Attorney, Agent, or Firm*—Volpe & Koenig

[57] ABSTRACT

A split heddle for controlling a yarn is particularly useful in automated seaming machines. The heddle is comprised of two blade like members. Each member has an aperture which is intersected on one side by a slot and on the other side by a groove. The members are superimposed with the apertures in alignment and the grooves opposite the slots. The unit is secured by laser, spot or sonic welding. After insertion of the yarn(s) in the aperture, the heddle is rotated 180° with respect to the yarn(s) and the yarn(s) is/are captured in the channel formed by the opposed grooves.

16 Claims, 1 Drawing Sheet

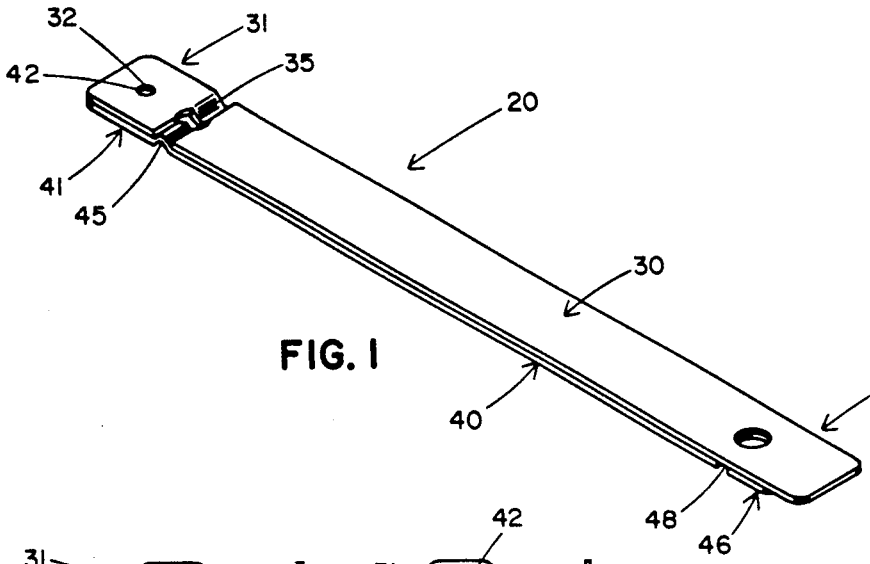
FIG. 1
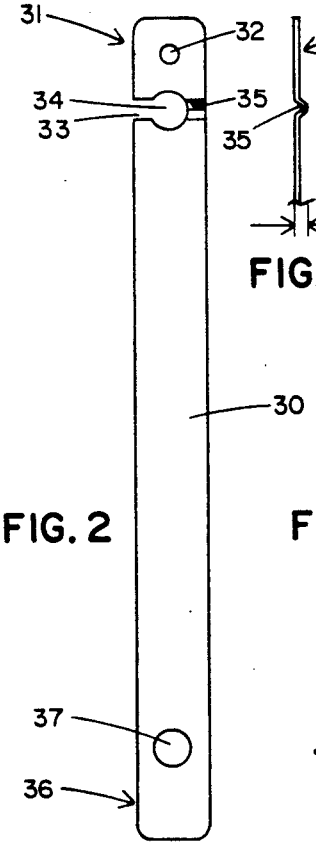
FIG. 2
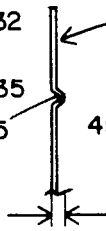
FIG. 3
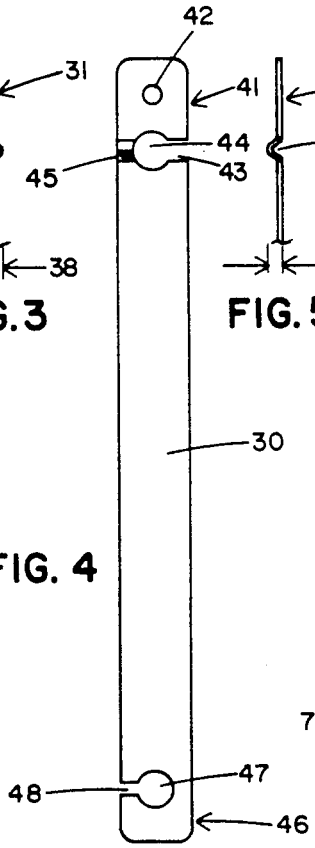
FIG. 4
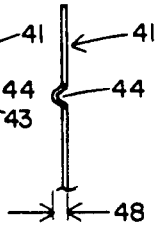
FIG. 5
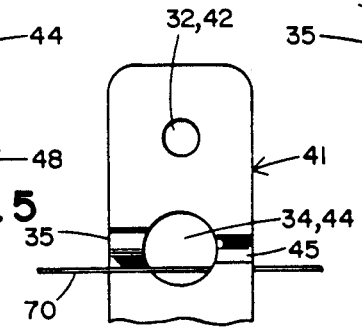
FIG. 7
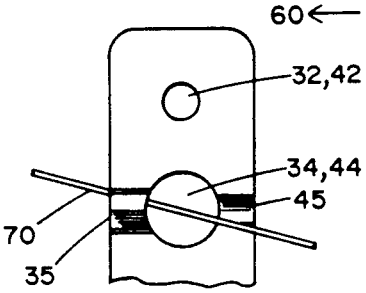
FIG. 8
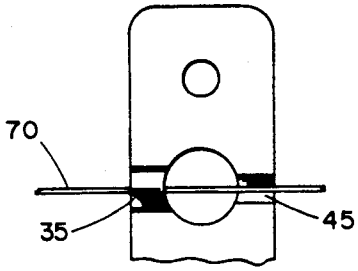
FIG. 9
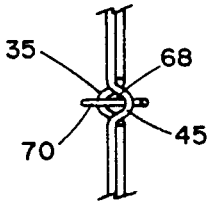
FIG. 10
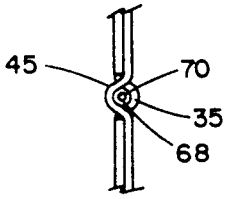
FIG. 11
FIG. 6
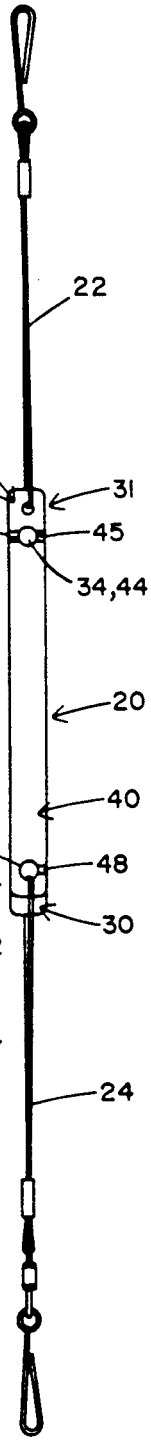

SPLIT HEDDLE WITH SUPERIMPOSED BLADES WITH ALIGNED APERTURES

BACKGROUND OF THE INVENTION

1. Field of the Invention

The present invention relates generally to heddles for use in weaving and more particularly to split heddles for use in connection with automated seaming of flat woven fabrics. In particular, the present invention finds use in automatic seaming equipment which utilizes a Jacquard Machine in the shed formation process.

2. Description of the Prior Art

For some time, the art has recognized the advantages to be gained from split heddles. One prior art split heddle used for automatic seaming is comprised of two stainless steel strips which are secured about a stainless steel spacing washer. The two stainless steel strips and the spacing washer are bonded together in a sandwich like arrangement. The assembly of this prior art heddle requires that great care be taken in the positioning and bonding of the individual pieces. Misalignment of the various pieces cannot be tolerated. In addition to problems with misalignment, the prior art device is not tolerant of any curvature in the metal strips. Curvature in the metal strips caused an opening in the washer area and this opening frequently resulted in a failure to retain the strand within the heddle. Although the prior art device was frequently used, the above factors contributed to a high cost of construction, a high rate of rejection during manufacturing of the heddles and high maintenance during weaving.

It is the purpose of the present invention to provide a heddle which eliminates the need for a spacing washer, improves the tolerance of the heddle for curvature in the metal strips and reduces maintenance.

SUMMARY OF THE INVENTION

The heddle is comprised to two superimposed blades. Each blade has an aperture in communication with a slot and an arcuate groove or channel. The blades are superimposed and bonded with the grooves facing in opposite directions and extending through the slot in the opposing blade. The apertures and the opposed grooves define a yarn passage or channel in the heddle.

BRIEF DESCRIPTION OF THE DRAWINGS

FIG. 1 is a perspective view of the heddle in accordance with the present invention.

FIG. 2 is a front elevation of a first heddle strip in accordance with the heddle of the present invention.

FIG. 3 is a fragmentary side elevation of the heddle strip of FIG. 2.

FIG. 4 is a front elevation of a second heddle strip in accordance with the heddle of the present invention.

FIG. 5 is a side elevation of the heddle strip of FIG. 4.

FIG. 6 is a front elevation of the heddle strip of FIG. 1 rotated 180° and assembled with heddle leads.

FIGS. 7, 8 and 9 illustrate the use and rotation of the present heddle as shown in FIG. 6. FIG. 7 represents the zero position; FIG. 8 represents 90° of rotation; and FIG. 9 represents 180° of rotation.

FIG. 10 is a fragmentary section illustrating the position of a yarn as it is placed in the heddle.

FIG. 11 illustrates the capture of the yarn in the heddle channel after a 180° rotation from the position depicted in FIG. 10.

DETAILED DESCRIPTION OF THE PREFERRED EMBODIMENT

The preferred embodiment will be described with reference to the drawings and like elements are identified by the same numeral throughout.

With reference to FIG. 1, the split heddle 20 of the present invention is comprised of two blade or strip members 30 and 40 which are bonded together at their respective ends 31 and 41. The blades 30 and 40 may be of the same or different length. In the preferred embodiment, blade 30 is slightly longer than blade 40. In the preferred embodiment, the blade 30 has an overall length, from end to end, of approximately 5.5 inches and the blade 40 has an overall end to end length of approximately 5.375 inches.

As noted previously with respect to FIG. 1, the heddle 20 is comprised of individual elongate blade members or strips, 30 and 40, which have been superimposed, aligned and bonded. Each blade has an aperture, 32 or 42, through its first end, 31 or 41. While it is preferable that the apertures 32 and 42 be in direct alignment, this is not critical to the invention. The respective heddle members 30 and 40 need only be in sufficient alignment to permit the oppositely facing arcuate grooves or channel portions 35 and 45 to be in sufficient alignment for a channel to be formed across the heddle. The reason for this alignment will become more evident upon reading the description hereinafter.

The preferred material for blades 30 and 40 is stainless steel. The preferred method of bonding is laser welding, however, spot-welding and sonic welding are alternative bonding methods.

In order to more fully understand the invention, each blade 30 and 40, will be desCribed individually. For this purpose, reference will be made to FIGS. 2 through 5.

Referring first to FIG. 2, strip 30 has a first end 31 having two apertures 32 and 34 which are generally on the longitudinal centerline. Aperture 32 has a diameter of approximately 0.065 inches. Aperture 34 has a diameter of approximately 0.128 inches. The aperture 34 is intersected on one side by a horizontal slot 33 which extends through to the edge of the blade member 30. Slot 33 has a width of approximately 0.078 inches. The aperture 34 is also in communication with the arcuate groove or channel portion 35. The groove 35 is on the centerline with the slot 33 and the aperture 34. This may be seen clearly with reference to FIG. 2. Groove 35 is concave with respect to the plane of the blade 30 as shown in FIG. 2; this is evident from FIG. 3. Groove 35 has a radius of approximately 0.009 inches. The blade, 30 has an overall average thickness of approximately 0.018 inches with the thickness at the groove 35, as illustrated by the numeral 38 in FIG. 3, being approximately 0.54 inches.

The blade 40 will be described with reference to FIGS. 4 and 5. The first end 41 of blade 40 is essentially a mirror image of end 31 of blade 30. All of the elements of end 41 correspond with the like element of end 31. However, it should be noted with respect to the groove 45, that it will be convex with respect to the plane of the blade 40. This may be clearly seen with reference to FIG. 1. Blade 30 differs from blade 30 as described hereinafter. As stated previously, the overall length of blade 40 is approximately 0.125 inches less than than that of blade 30. This may be seen with reference to FIG. 6. The aperture 47 in end 46 of blade 40 will be positioned opposite the aperture 37. Aperture 47 is intersected by horizontal slot 48 which extends through the end 46. Slot 48 is approximately 0.040 inches wide. The differential length is believed to make it easier to separate and move the blades during yarn insertion.

With reference to FIG. 1, it can be seen that the grooves 35 and 45 are facing in opposite directions and they cooperate to effectively close the apertures 34 and 44, FIGS. 3 and 4 and define a horizontal channel 68 across the heddle 20, FIGS. 10 and 11. Groove 35 fits through slot 43 and groove 45 fits through slot 33. As a result of their convex-concave configurations the grooves 35 and 45 each form one half of the horizontal channel 68 across the heddle. Channel 68 has a diameter of approximately 0.033 inches but may be dimensioned to accommodate the yarns that are to be controlled.

With reference to FIG. 6, the heddle 20 is assembled with lead lines 22 and 24. The two blade members 30 and 40 are assembled together, such as by sonic or spot welding at the respective ends 31 and 41. The lead line 22 passes through apertures 32 and 42. The lead line 24 passes through apertures 37 and 47. As known by those skilled in the art, the lead lines 22 and 24 provide a means of controlling the heddle during weaving. Other control means may be used. Due to the existence of slot 48 in the end 46, blade 40 may be separated from blade 30 and moved to the side, as indicated by arrow 60, by passing lead 24 through the slot 48. This movement of blade 40 provides a separation between the blades 30 and 40 so that a yarn may be passed between the blades and into the apertures 34 and 44. This positioning of a yarn 70 in the apertures 34 and 44 is shown in FIG. 7. At this point in time, the yarn 70 extends over groove 35 which is convex with respect to the frontal plane of the figure and behind groove 45 which is concave with respect to the frontal plane of the figure. After a rotation of approximately 90°, the yarn 70 will be within the apertures 34 and 44, see FIG. 8. By continuing the rotation through 180°, the yarn 70 will be positioned so that it now extends in a straight line and rests within the cross channel 68 formed by the opposed grooves 35 and 45, see FIG. 9. At this point in time, the yarn 70 is captured by the heddle and will be retained in that position regardless of slight variations or curvatures in members 30 and 40 and/or slight variations with respect to precise alignment of the ends 31 and 41 and/or the arcuate portions 35 and 45.

FIG. 10 illustrates the position of yarn 70 relative to channel 68 prior to rotation and FIG. 11 illustrates the position of yarn 70 in the channel 68 after rotation through 180°.

If desired, the second blade may be shorter and the aperture 47 and the slot 48 may be eliminated. Since there is virtually no space between the blade members 30 and 40, they will be in very close contact. Since the channel 68 is closed, a yarn will not slip between the blades 30 and 40, even if the lead line 24 does not pass through the aperture 47.

As can be seen from the foregoing, a simplified heddle construction with improved yarn control reliability has been disclosed.

What I claim is:

1. A heddle for controlling the movement of a yarn, said heddle comprised of:

a first member having two apertures aligned one above the other at a first end thereof and a single aperture at the other end thereof, the lower aperture at the first end being intersected on one side thereof by a perpendicular slot and on the opposite side thereof by a perpendicular groove; and, a second member which is the mirror image of said first member, the first and second members being secured at their first ends with the respective grooves facing in opposite directions and defining a yarn capturing channel.

2. The heddle of claim 1 wherein the perpendicular groove extends through the opposed slot.

3. The heddle of claim 2 wherein each of the perpendicular grooves forms one half of the yarn capturing channel.

4. The heddle of claim 1 wherein the first and second members are secured by spot welding.

5. The heddle of claim 1 wherein the first and second members are secured by sonic bonding.

6. The heddle of claim 1 wherein the first and second members are secured by laser welding.

7. The heddle of claim 1 wherein the first and second members are stainless steel.

8. The heddle of claim 7 wherein the first and second members are secured by laser welding.

9. The heddle of claim 1 wherein the first and second members have an overall average thickness of approximately 0.018 inches.

10. The heddle of claim 1 wherein the heddle has a thickness at the oppositely facing grooves of approximately 0.54 inches.

11. The heddle of claim 10 wherein the first and second members have an overall average thickness of approximately 0.018 inches.

12. The heddle of claim 11 wherein the first and second members are secured by laser welding.

13. A heddle comprised of:

a first elongate member having an aperture positioned on its longitudinal centerline with the aperture being intersected on one side thereof by a slot which is perpendicular to the centerline and on the other side thereof by a groove which is perpendicular to the longitudinal centerline and generally on centerline with the slot;

a second elongate member having an aperture, a slot and a groove which are the mirror image of the said aperture, slot and groove in the first elongate member;

said first and second elongate member being superimposed over each other with the apertures being concentric and the respective groove extending into the opposite slot, whereby the opposed grooves form a cross channel perpendicular to the longitudinal centerline; and the thickness of the heddles at the opposite grooves is approximately 0.54 inches.

14. The heddle of claim 13 wherein each of the opposed grooves forms one half of the cross channel.

15. The heddle of claim 13 wherein the first and second elongate members are stainless steel.

16. The heddle of claim 13 are secured together by laser welding.

* * * * *

UNITED STATES PATENT AND TRADEMARK OFFICE

CERTIFICATE OF CORRECTION

PATENT NO. : 5,005,608

DATED : April 9, 1991

INVENTOR(S) : Larry D. Anderson

It is certified that error appears in the above-identified patent and that said Letters Patent is hereby corrected as shown below:

At column 1, line 41, delete the word "to" and insert therefor --of--.

At column 2, line 38, delete the word "desCribed" and insert therefor --described--.

At column 2, line 58, delete the numeral "0.54" and insert therefor --.054--.

At column 2, line 66, delete the first occurrence of the numeral "30" and insert therefor --40--.

At column 2, line 68, delete the first occurrence of the word "than".

IN THE CLAIMS

In claim 10, column 4, line 35, delete the numeral "0.54" and insert therefor --.054--.

In claim 13, column 4, line 60, delete the numeral "0.54" and insert therefor --.054--.

IN THE DRAWINGS

In Figure 4, delete reference numeral "30" and insert therefor --40--.

UNITED STATES PATENT AND TRADEMARK OFFICE

CERTIFICATE OF CORRECTION

PATENT NO. : 5,005,608

DATED : April 9, 1991

INVENTOR(S) : Larry D. Anderson

It is certified that error appears in the above-identified patent and that said Letters Patent is hereby corrected as shown below:

In Figure 5, delete reference numeral "48" and insert therefor --38--.

Signed and Sealed this

Sixth Day of October, 1992

*Attest:*

DOUGLAS B. COMER

*Attesting Officer*

*Acting Commissioner of Patents and Trademarks*